US007654886B2

(12) United States Patent
Chang

(10) Patent No.: US 7,654,886 B2
(45) Date of Patent: Feb. 2, 2010

(54) PNEUMATIC GRINDER

(76) Inventor: Tse-Hua Chang, No. 86-15, Shencing Rd., Cingshuei Township, Taichung County (TW)

( * ) Notice: Subject to any disclaimer, the term of this patent is extended or adjusted under 35 U.S.C. 154(b) by 176 days.

(21) Appl. No.: 11/778,211

(22) Filed: Jul. 16, 2007

(65) Prior Publication Data

US 2009/0023365 A1 Jan. 22, 2009

(51) Int. Cl.
*B24B 27/08* (2006.01)

(52) U.S. Cl. ..... 451/359

(58) Field of Classification Search ..... 451/359
See application file for complete search history.

(56) References Cited

U.S. PATENT DOCUMENTS 2,251,329 A * 8/1941 Ekstrom ..... 91/179
3,108,409 A * 10/1963 Hendrickson ..... 451/356
3,274,895 A * 9/1966 Hendrickson ..... 91/179
5,218,790 A * 6/1993 Huang ..... 451/359
5,706,996 A * 1/1998 Lee ..... 227/130
5,919,085 A * 7/1999 Izumisawa ..... 451/357
5,993,305 A * 11/1999 Chu ..... 451/357
6,190,245 B1 * 2/2001 Heidelberger et al. ..... 451/357
6,969,311 B2 * 11/2005 Chen et al. ..... 451/359
7,238,095 B1 * 7/2007 Sun et al. ..... 451/344
2005/0020196 A1 * 1/2005 Chen et al. ..... 451/359

* cited by examiner

*Primary Examiner*—Maurina Rachuba
(74) *Attorney, Agent, or Firm*—Egbert Law Offices PLLC

(57) ABSTRACT

The present invention is a pneumatic grinder, with a housing, an air chamber stand, and a rotor. The air chamber stand includes a cylinder, an upper cover and a lower cover. The cylinder is fitted with an inlet hole and an exhaust hole. There is a lateral exhaust hole assembled on the upper cover or lower cover or both covers and provided with a vertical internal borehole section linking the air chamber within the air chamber stand, and a transverse external borehole section. The air exhaust capacity of the air chamber stand is increased, markedly reducing turbulence and improving rotational speed and strength of the rotor. The vibration of rotor is efficiently reduced for the users, thereby improving significantly the torque, performance and quality of the pneumatic grinder with better applicability.

7 Claims, 8 Drawing Sheets

PNEUMATIC GRINDER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a pneumatic grinder, and more particularly to an innovative pneumatic grinder with exhaust holes on an air chamber stand.

2. Description of Related Art Including Information Disclosed Under 37 CFR 1.97 and 37 CFR 1.98.

The operation of a pneumatic grinder is mainly implemented through a rotor in an air chamber stand. Since inlet holes and exhaust holes are separately set onto the wall of the air chamber stand, the rotor is driven by air that is guided into the air chamber stand from the inlet hole. When the rotor is rotated to a preset angle, air is discharged from the exhaust hole, so that the rotor can continuously drive the eccentric seat of the pneumatic grinder to generate vibration.

During operation of the aforementioned pneumatic grinder's rotor, the torque relies a lot on the performance of the exhaust process. However, since the exhaust holes of the typical air chamber stand are only set on the wall in a fine-mesh pattern, a poor exhaust effect is often observed, leading to turbulence within air chamber stand and lower rotational speed and torque of the rotor. If the rotor vibrates strongly, the users may find it uncomfortable to hold firmly, bringing about depressed working behavior and poor performance and quality.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is that the present invention provides an improved structure of a pneumatic grinder with an innovation of lateral exhaust holes assembled onto an upper cover and/or lower cover, thus increasing air exhaust capacity of the air chamber stand via the lateral exhaust holes. The turbulence in air-chamber stand are markedly reduced, and the rotational speed and strength of rotor are improved. Meanwhile, the vibration of the rotor can be reduced efficiently for the benefit of the users, thereby significantly improving the torque, performance and quality of pneumatic grinder with better applicability.

The improvements brought about by the pneumatic grinder of the present invention include a unique structure that has a waveform gasket assembled between the loop coil and the lower cover of the air chamber stand. This waveform gasket under pressure yields an elastic force, enabling the loop coil and air chamber stand to be positioned more stably against any air leakage.

Moreover, the upper cover and lower cover are connected to the cylinder by a waveform gasket, so as to strengthen the airtight condition between the cylinder and upper and lower covers. The elastic upper and lower airtight cylinders can create an elastic and airtight state for the upper and lower cover surfaces that are connected, so that the upper and lower cover surfaces can be maintained as airtight even when slight loosening occurs.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
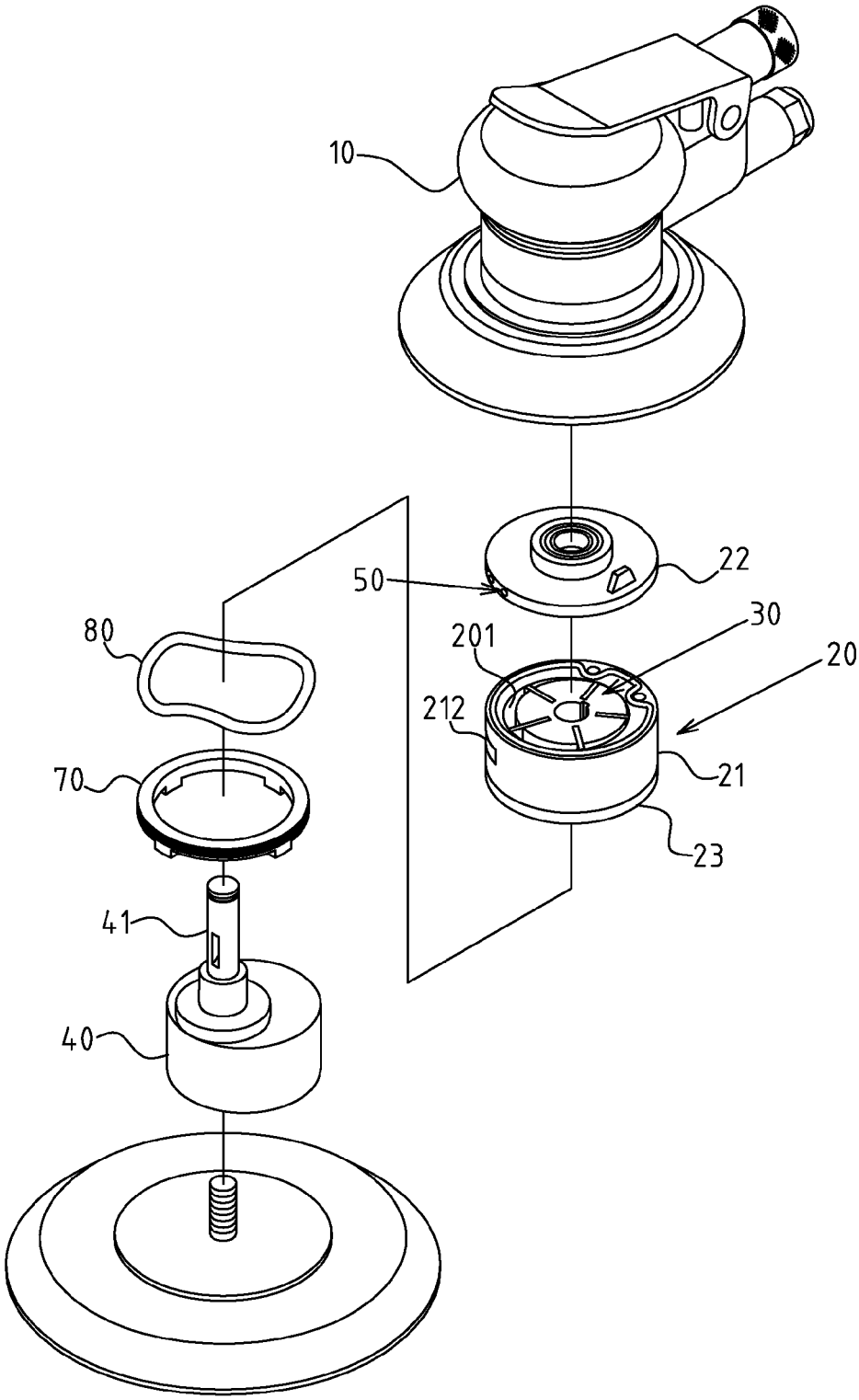
FIG. 1 shows an exploded perspective view of the preferred embodiment of the present invention.
Figure 2:
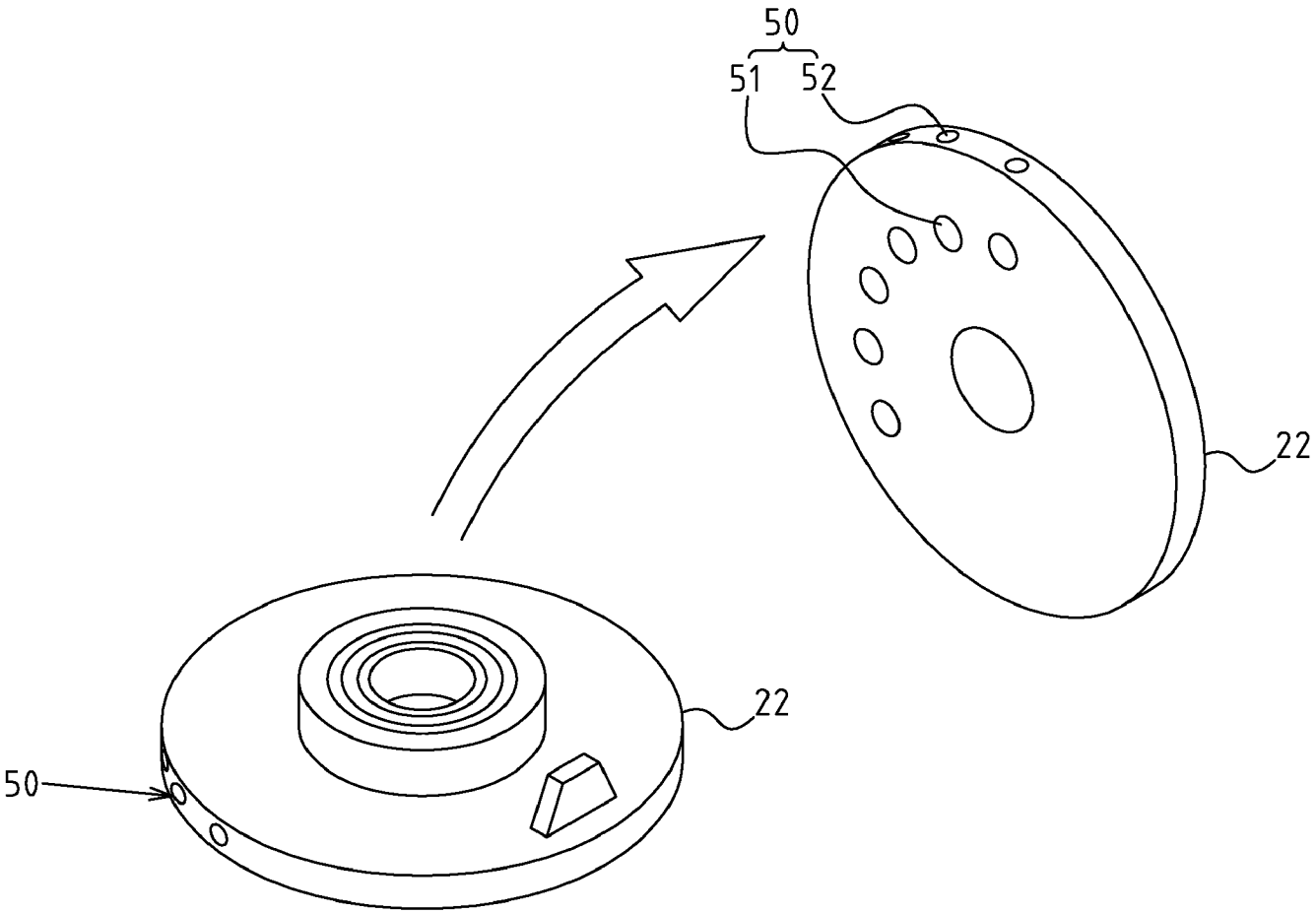
FIG. 2 shows an upward perspective view of the upper cover of the present invention.
Figure 3:
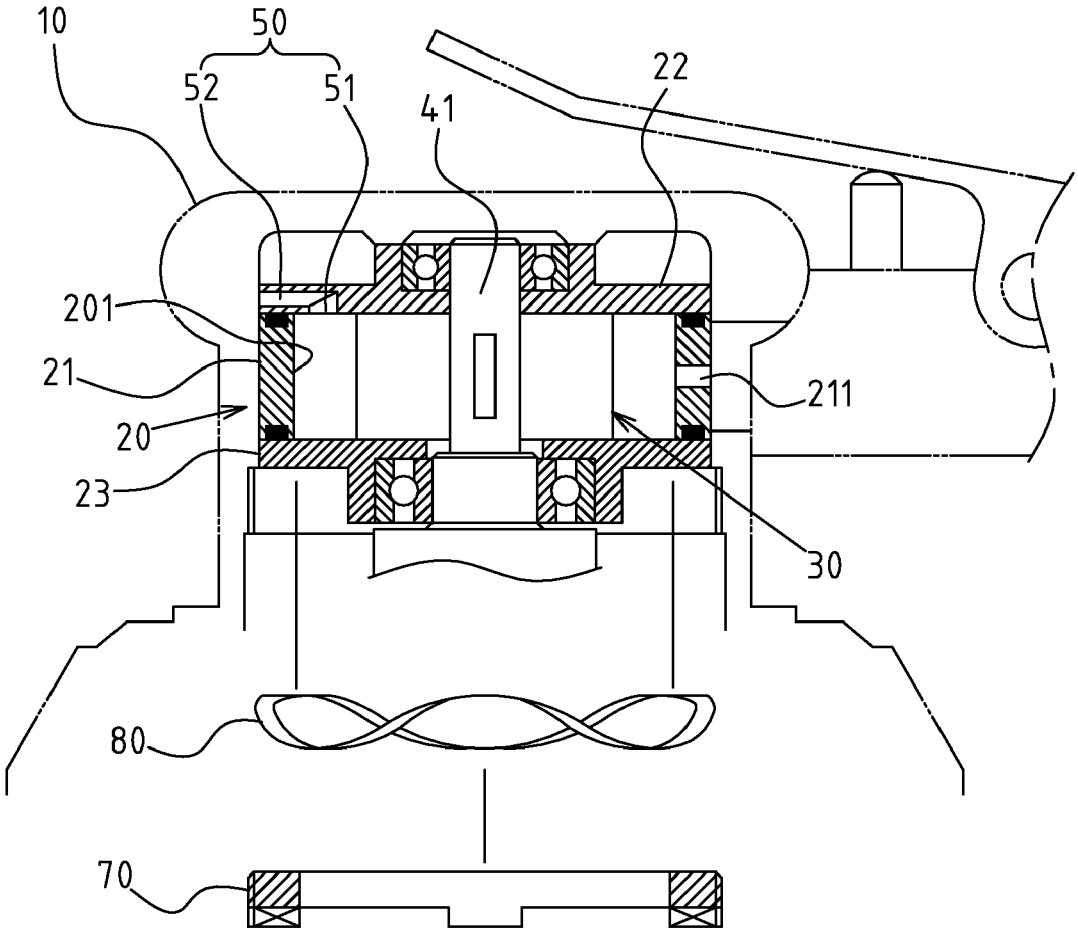
FIG. 3 shows a cross-sectional view of the preferred embodiment of the present invention (of which the loop coil and waveform gasket are in an exploded state).

FIGS. 1-3 depict preferred embodiments of pneumatic grinder of the present invention. The embodiments are provided only for explanatory purposes.

The housing 10 of the pneumatic grinder comprises an air chamber stand 20 assembled with a rotor 30 and brake rod 41 of eccentric seat 40. The air-chamber stand 20 comprises a cylinder 21, an upper cover 22 and lower cover 23. The cylinder 21 is fitted with inlet holes 211 (shown in FIG. 3) and exhaust holes 212 (shown in FIG. 1), while the inlet and exhaust holes 211, 212 are linked to an air chamber 201 within the air-chamber stand 20.

A feature of the present invention includes a lateral exhaust hole 50 assembled on the upper cover 22 or lower cover 23 or both. The lateral exhaust hole 50 is provided with a vertical internal borehole section 51 linking air chamber 201 within air chamber stand 20. The lateral exhaust hole 50 is also provided with a transverse external borehole section 52 protruding from the edge of upper cover 22 or lower cover 23 or both.

Referring to FIGS. 1-4, the vertical internal borehole section 51 and transverse external borehole section 52 of the lateral exhaust hole 50 may be prefabricated via the upper cover 22 or lower cover 23 or both. For example, if the upper and lower covers 22, 23 are made of plastics, then the lateral exhaust hole 50 could be fabricated by an injection molding machine.

Figure 4:
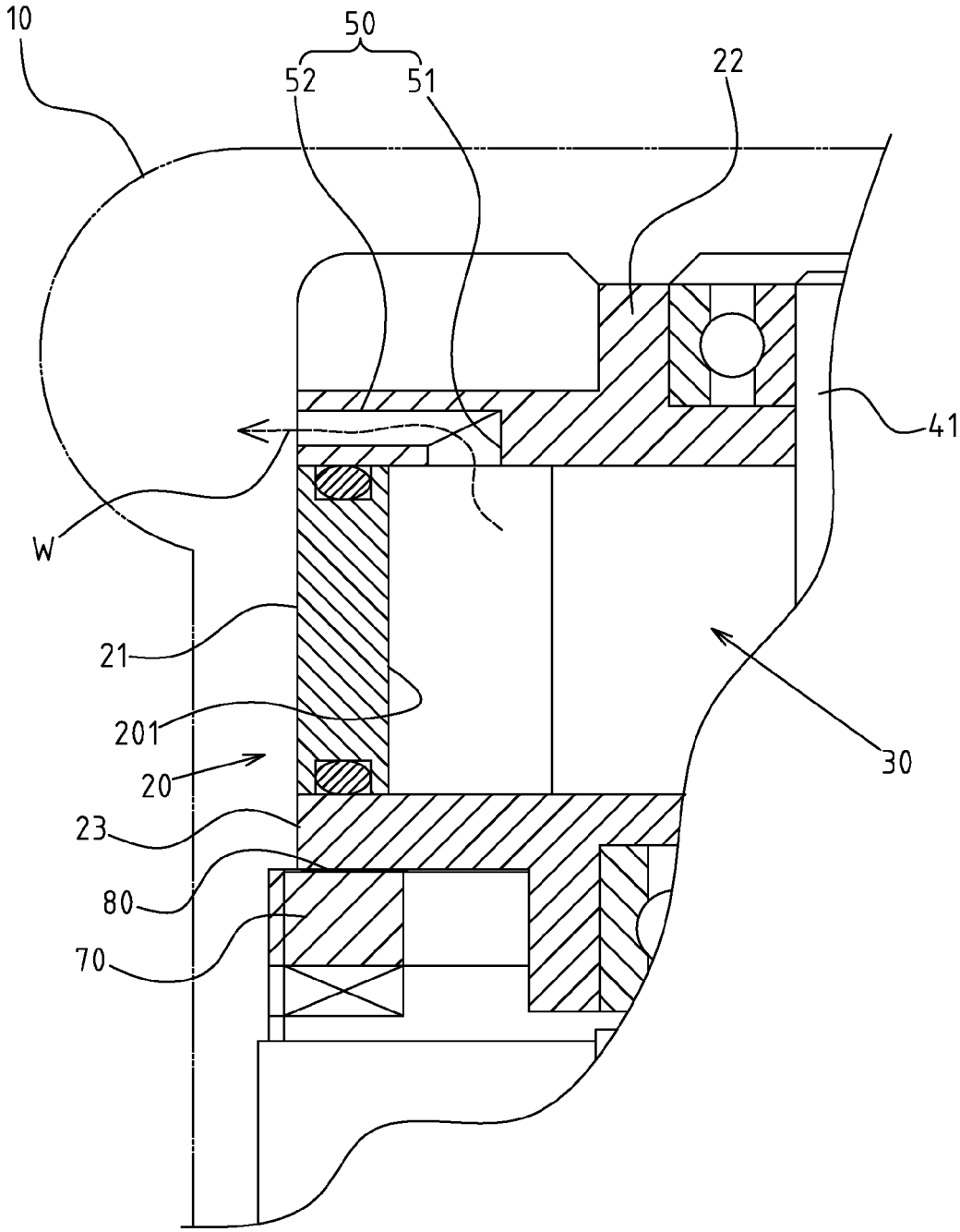
FIG. 4 shows a schematic view of the flow path of a lateral exhaust hole of the present invention which enables air exhaust.

Referring to FIG. 4, when air is guided into the rotor 30 of air chamber stand 20 for driving it to a preset angle, air current W can be discharged either from exhaust hole 212 (shown in FIG. 1) of cylinder 21, or from lateral exhaust hole 50 of the upper cover 22 or lower cover 23 or both. In the example, the lateral exhaust hole 50 is only shown in the upper cover 22. In all cases, air exhaust is improved, and turbulence is reduced.

Figure 5:
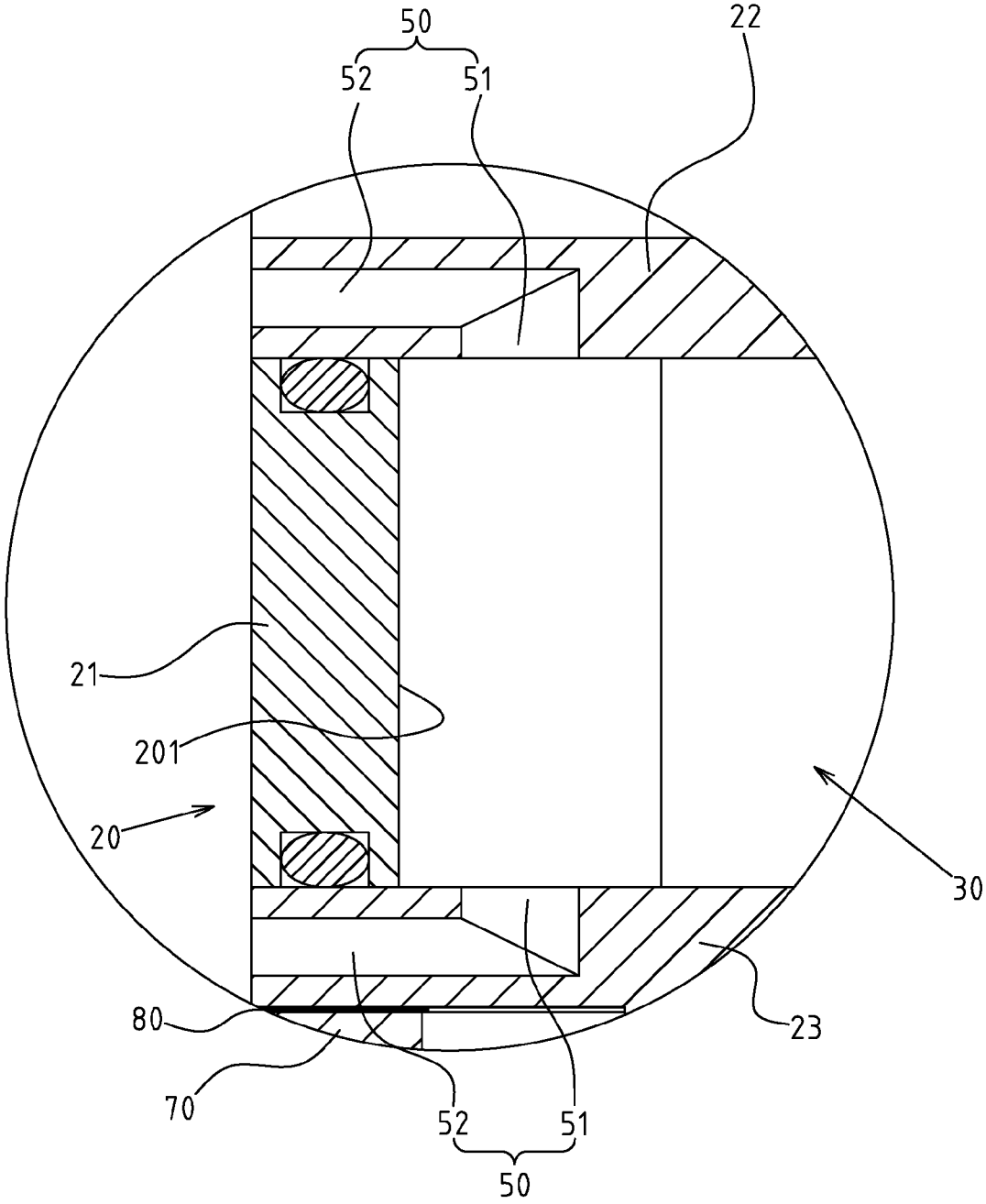
FIG. 5 shows a cross-sectional view of the application of the upper and lower covers, both of which are fitted with lateral exhaust holes.

Referring to FIG. 5, the upper and lower covers 22, 23 are fitted with lateral exhaust holes 50.

Figure 7:
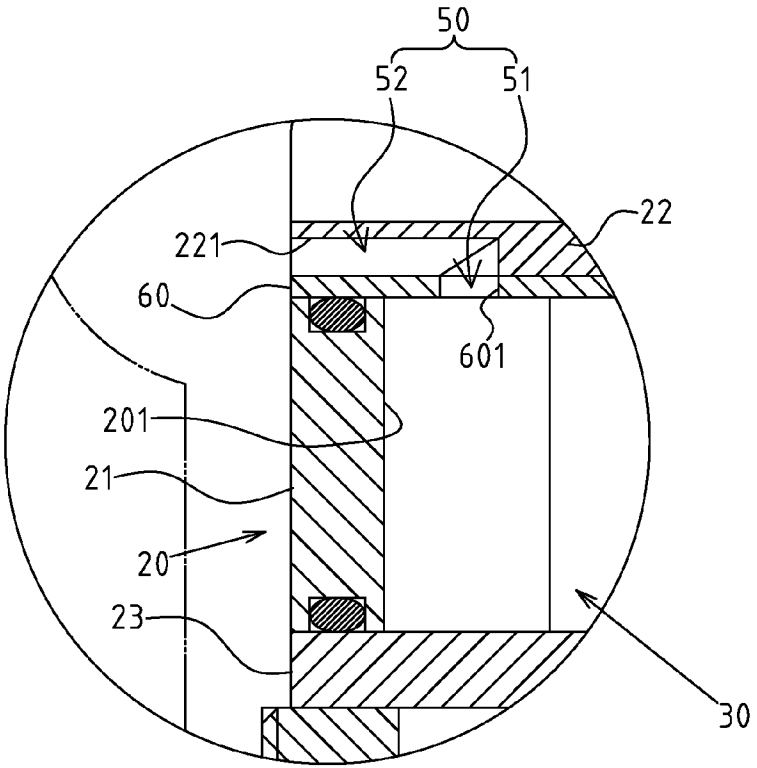
FIG. 7 shows a cross-sectional view of another application of lateral exhaust hole of the present invention.
Figure 6:
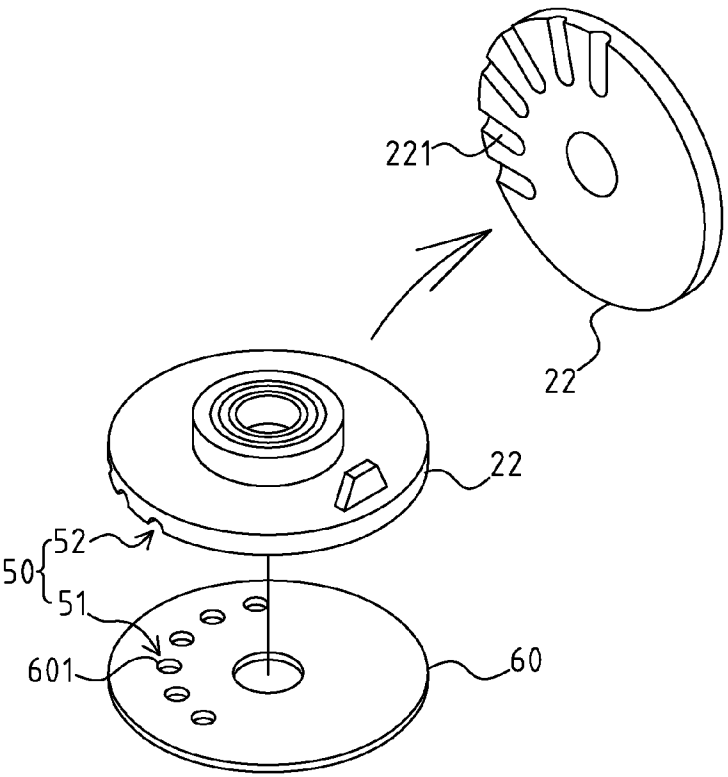
FIG. 6 shows an exploded perspective view of another application of lateral exhaust hole of the present invention.
Figure 9:
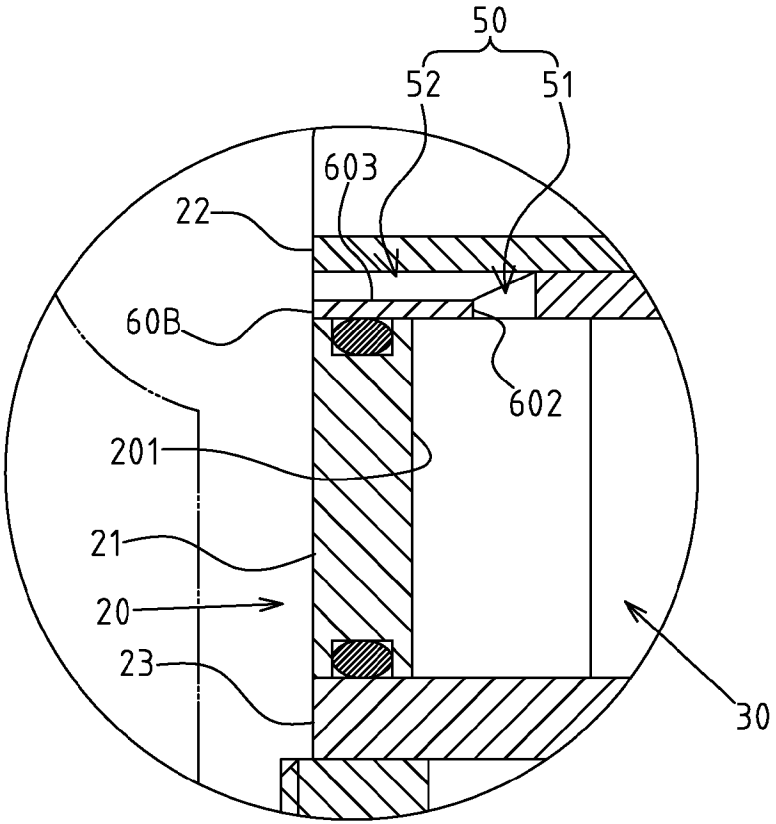
FIG. 9 shows a cross-sectional view of another application of lateral exhaust hole of the present invention.
Figure 8:
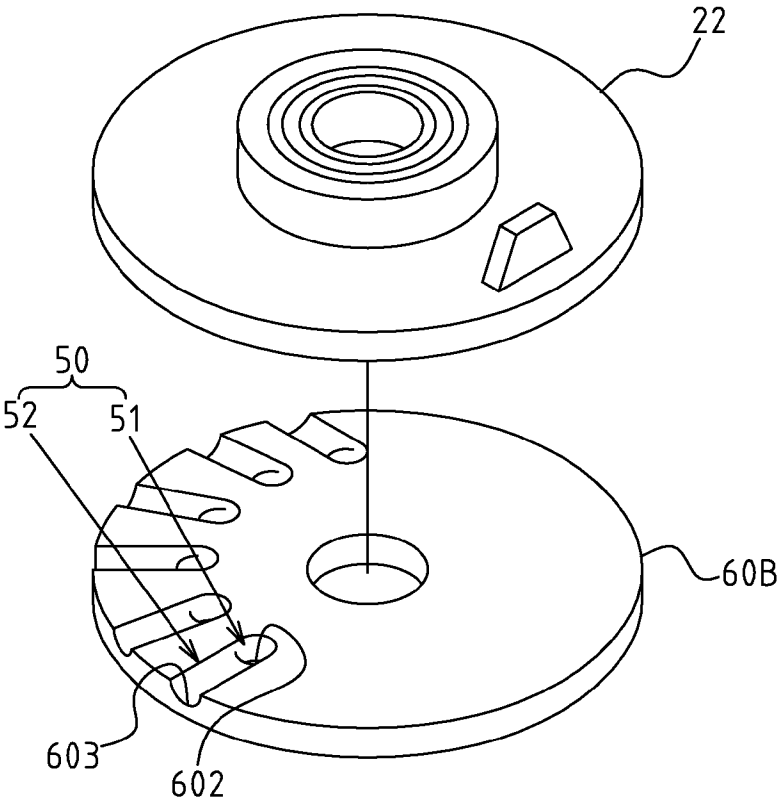
FIG. 8 shows an exploded perspective view of another application of lateral exhaust hole of the present invention.

Referring to FIGS. 6 and 7, the upper cover 22 is fitted with a gasket 60, where vertical through-holes 601 are set to form a vertical internal borehole section 51 on lateral exhaust holes 50. The upper cover 22 is internally provided with grooves 221 protruding laterally to form transverse external borehole section 52 on lateral exhaust hole 50. The lower cover 23 may also be fitted with a gasket 60 in the same manner as the upper cover 22 in FIGS. 6 and 7. Moreover, referring to FIGS. 8 and 9, vertical through-holes 602 are set on the gasket 60B to form vertical internal borehole section 51 on lateral exhaust hole 50. Then, the gasket 60B is provided externally with grooves 603 linking the vertical internal borehole section 51. The inner surface of upper cover 22 contacts the gasket 60B to cover the open side of groove 603, thus forming transverse external borehole section 52 on the lateral exhaust hole 50. The lower cover 23 may also be fitted with a gasket 60B in the same manner as the upper cover 22 in FIGS. 8 and 9.

Figure 11:
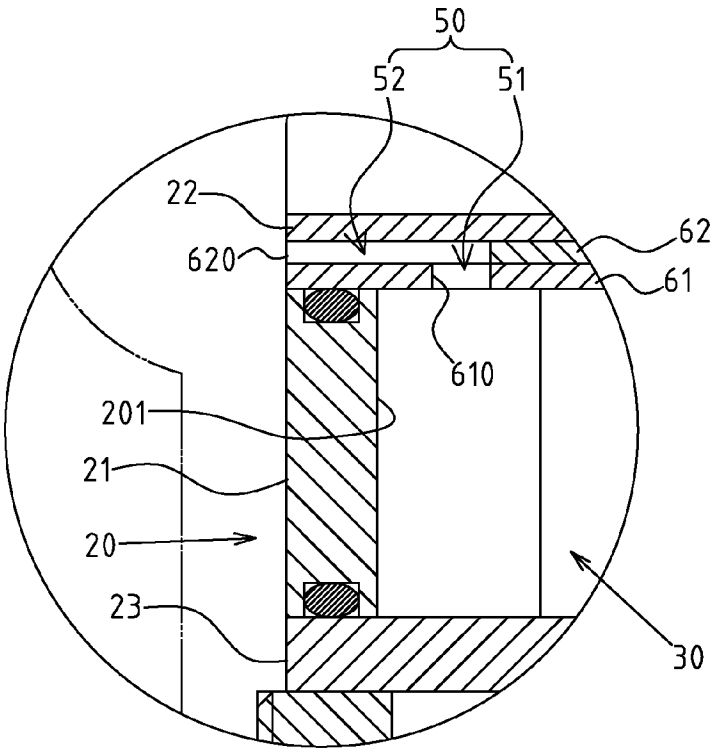
FIG. 11 shows a cross-sectional view of another application of lateral exhaust hole of the present invention.
Figure 10:
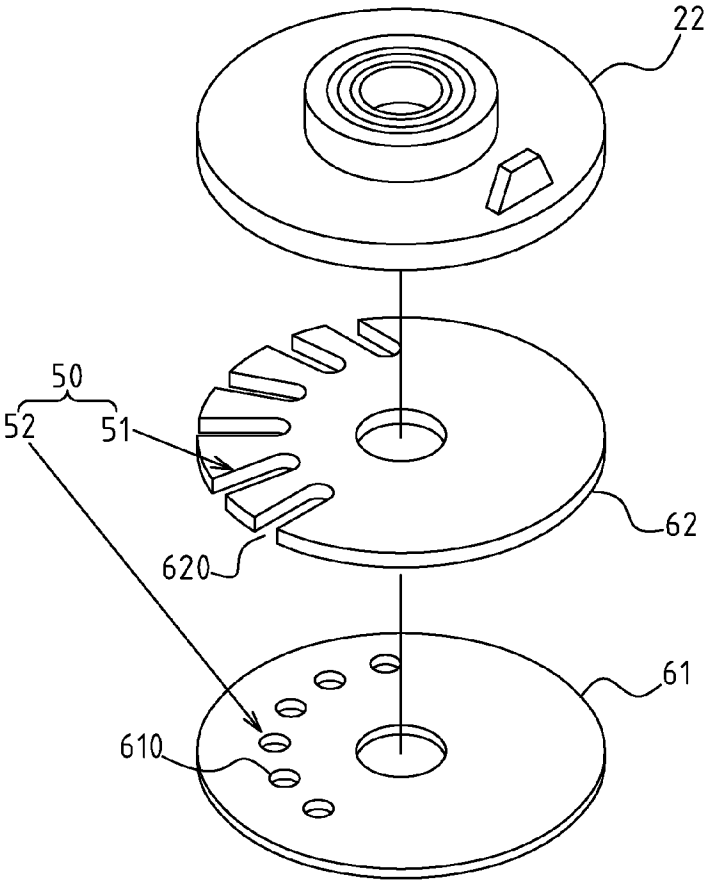
FIG. 10 shows an exploded perspective view of another application of lateral exhaust hole of the present invention.

Referring to FIGS. 10 and 11, the upper cover 22 is fitted internally with the first gasket 61 and second gasket 62, so that vertical through-holes 610 are set on the first gasket 61 to form vertical internal borehole section 51 on lateral exhaust hole 50, and long through-holes 620 are protruded laterally from the second gasket 62 to link the vertical internal borehole section 51. Moreover, the inner surface of upper cover 22 contacts the second gasket 62 to cover the long through-hole, thus forming transverse external borehole section 52 on the lateral exhaust hole 50. The lower cover 23 may also be fitted with first gasket 61 and second gasket 62 in the same manner as the upper cover in FIGS. 10 and 11.

The housing 10 of the pneumatic grinder is fitted with a loop coil 70, which is locked onto a bottom of lower cover 23 of air chamber stand 20. A waveform gasket 80 is assembled between the loop coil 70 and lower cover 23 of air chamber stand 20. This waveform gasket 80 under pressure could yield elastic force, enabling the loop coil 70 to be positioned more stably.

As shown in FIG. 4, the upper cover 22 is connected to the cylinder 21 and installed with a waveform gasket 80, such as a rubber ring. The waveform gasket 80 can be affixed to the groove 213 on the surface of the cylinder 21 for better stability. The lower cover 23 may also be connected to cylinder 21 and installed with a waveform gasket in the same manner as the upper cover in FIG. 4. Both the upper cover 22 and lower cover 23 may also be connected to cylinder 21 and installed with a waveform gasket, as described.

I claim:

1. A pneumatic grinder structure comprising:

a housing having a rotor and a brake rod therein, said brake rod being mounted on an eccentric seat;

an air chamber stand mounted in said housing and receiving said rotor and said brake rod therein, said air chamber stand having an air chamber therein, said air chamber stand comprising:

a cylinder having an inlet hole and an exhaust hole formed thereon, said inlet hole and said exhaust hole being in fluid communication with said air chamber;

an upper cover affixed to one side of said cylinder; and a lower cover affixed to an opposite side of said cylinder, at least one of said upper cover and said lower cover having a lateral exhaust hole, said lateral exhaust hole having a vertical internal borehole section in communication with said air chamber, said lateral exhaust hole having a transverse external borehole section protruding from an edge of the one of said upper cover and said lower cover.

2. The pneumatic grinder structure of claim 1, said vertical internal borehole section and said transverse external borehole section being formed in the one of said upper cover and said lower cover.

3. The pneumatic grinder structure of claim 1, each of said upper cover and said lower cover having a gasket in sealing relation with said cylinder, said gasket having said vertical internal borehole section formed herein, said transverse external borehole section being a groove formed laterally on a surface of the one of said upper cover and said lower cover.

4. The pneumatic grinder structure of claim 3, said groove being formed on an inner surface of the one of said upper cover and said lower cover, said groove having an end opening to said vertical internal borehole section of said gasket.

5. The pneumatic grinder structure of claim 1, the one of said upper cover and said lower cover having a first gasket and a second gasket in sealing relation with said cylinder, said first gasket having said vertical internal borehole section formed therein, said second section having a groove formed therein so as to define said transverse external borehole section.

6. The pneumatic grinder structure of claim 1, said housing having a loop coil locked onto a bottom of said lower cover, said housing having a waveform gasket assembled between said loop coil and said lower cover.

7. The pneumatic grinder structure of claim 1, further comprising:

a first waveform gasket interposed between said upper cover and said cylinder; and a second waveform gasket interposed between said lower cover and said cylinder.

* * * * *